US006163206A

United States Patent [19]

Kobayashi

[11] Patent Number: 6,163,206

[45] Date of Patent: Dec. 19, 2000

[54] SEMICONDUCTOR INTEGRATED CIRCUIT DEVICE HAVING RECOVERY ACCELERATOR FOR CHANGING BIAS CIRCUIT FROM STANDBY MODE WITHOUT MALFUNCTION

[75] Inventor: Shotaro Kobayashi, Tokyo, Japan

[73] Assignee: NEC Corporation, Tokyo, Japan

[21] Appl. No.: 09/290,181

[22] Filed: Apr. 13, 1999

[30] Foreign Application Priority Data

Apr. 14, 1998 [JP] Japan ..... 10-103004

[51] Int. Cl.[7] ..... G05F 3/02

[52] U.S. Cl. ..... 327/540; 327/77; 327/143

[58] Field of Search ..... 323/312, 313, 323/314, 315; 327/77, 143, 198, 538, 540, 541, 543, 545, 546

[56] References Cited

U.S. PATENT DOCUMENTS 5,892,392 4/1999 Morche ..... 327/544

*Primary Examiner*—Jeffrey Zweizig

*Attorney, Agent, or Firm*—Sughrue, Mion, Zinn, Macpeak & Seas, PLLC

[57] ABSTRACT

A bias controller regulates bias current flowing out from an analog circuit to an appropriate value in an active mode, and decreases the current to zero in a standby mode, wherein the bias controller has a recovery accelerator detecting a bias voltage proportional to the bias current for terminating an acceleration of a change from the standby mode to the active mode, thereby accurately controlling the acceleration regardless of the transistor characteristics and a difference between a designed operating temperature and an actual operating temperature.

14 Claims, 6 Drawing Sheets

SEMICONDUCTOR INTEGRATED CIRCUIT DEVICE HAVING RECOVERY ACCELERATOR FOR CHANGING BIAS CIRCUIT FROM STANDBY MODE WITHOUT MALFUNCTION

FIELD OF THE INVENTION

This invention relates to a semiconductor integrated circuit device and, more particularly, to a semiconductor integrated circuit device having a power supply circuit switched between a standby mode and an active mode.

DESCRIPTION OF THE RELATED ART

Various analog circuits have been proposed for a semiconductor integrated circuit device, and the analog circuits are biased with reference current. The analog circuit constantly consumes the reference current. If the reference current continuously flows through the analog circuit in standby state, the reference current is wasteful. For this reason, a semiconductor integrated circuit device stops the reference current upon entry into the standby state, and starts to supply the reference current to the analog circuit in response to a request for recovery. However, a high-performance electric system requires a quick response to the request for the recovery, and the device manufacturer is expected to shorten the recovery time.

FIG. 1 illustrates a prior art bias circuit, The prior art bias circuit is changed between the active mode and the standby mode. A constant Current source I1 flows constant current ISTD into a node VSTD, and the constant current ISTD further flows from the node VSTD into an n-channel enhancement type field effect transistor N1. The n-channel enhancement type field effect transistor N1 has a source node connected to a ground line GND and a drain node and a gate electrode both connected to the node VSTD. The n-channel enhancement type field effect transistor N1 form in combination a current mirror circuit CM1 together with an n-channel enhancement type field effect transistor N2. If the n-channel enhancement type field effect transistor N1 is equal in channel dimensions to the n-channel enhancement type field effect transistor N2, the amount of current ISTD is equal to the amount of current passing through the n-channel enhancement type field effect transistor IMIRR. The ratio between the current ISTD and the current IMIRR is variable depending upon the ration of the channel dimensions between the n-channel enhancement type field effect transistor N1 and the n-channel enhancement type field effect transistor N2.

The n-channel enhancement type field effect transistor N2 is connected through a transfer gate, i.e., a parallel combination of an n-channel enhancement type field effect transistor N3 to a node Vsource, and a p-channel enhancement type field effect transistor P2 has a source-and-drain path between a power voltage line Vdd and the node Vsource and a gate electrode connected to the node Vsource. The p-channel enhancement type field effect transistor P2 forms a current mirror circuit CM2 together with a p-channel enhancement type field effect transistor P3, and the p-channel enhancement type field effect transistor P3 has a source-and-drain path between the power supply line Vdd and a bias node Vbias. The gate electrode of the p-channel enhancement type field effect transistor P3 is connected to the node Vsource. The ratio between the current IMIRR and the current Ibias is variable depending upon the ratio of channel dimensions between the p-channel enhancement type field effect transistor P2 and the p-channel enhancement type field effect transistor P3.

An n-channel enhancement type field effect transistor N5 has a source-and-drain path between the bias node Vbias and the ground line GND, and the gate electrode of the n-channel enhancement type field effect transistor N5 is connected to the bias node Vbias.

Load circuits L1, L2, . . . and Ln are, by way of example, amplifiers supplied with bias current, and the circuit configuration is arbitrary. An example of the circuit configurational of the load circuit L1/L2/ . . . /Ln is shown in figure 2. A series combination of a resistor R and an input transistor TIN is connected between the power supply line Vdd and a common node COMN, and another series combination of a resistor RB and an input transistor TINB is connected in parallel to the series combination. A pair of input signal IN/INB is supplied to the load circuit. The input signal IN is supplied to the gate electrode of the input transistor TIN, and the complementary input signal INB is supplied to the gate electrode of the other input transistor TINB. The input signal IN and the complementary input signal INB are varied within a potential range from tens millivolts to hundreds millivolts, and the input transistors TIN/TINB produce a pair of output signals OUT/OUTB from the pair of input signals IN/INB. The output signals OUT/OUTB are varied within a potential range of the order of hundreds millivolts.

A current-source transistor TAIL1/TAIL2/ . . . /TAILn, which forms a part of the prior art bias circuit shown in FIG. 1, is connected between the common node COMN and the ground line GND. The current-source transistor TAIL1/TAIL2/ . . . /TAILn changes the amount of current passing through the source-and-drain path depending upon the bias voltage Vbias. However, when the bias voltage Vbias is too low, the amount of current passing through the input transistors TIN/TINB is insufficient for the amplification, and does not achieve the gain to be required. On the other hand, if the bias voltage Vbias is too high, the potential level at the common node COMN is lowered, and both input transistors TIN/TINB are turned on in the presence of the input signals IN/INB varied within the designed range. As a result, the potential range of the output signal OUT is deviated from the potential range of the other output signal OUTB. In the worst case, the input transistors TIN/TINB do not serve as a differential amplifier. Thus, an appropriate bias voltage Vbias is to be required for the differential amplifier TIN/TINB.

Turning back to FIG. 1, the current-source transistors TAIL1/TAIL2/ . . . /TAILn are implemented by n-channel enhancement type field effect transistors, and flow currents Ilocal1/Ilocal2/ . . . . /Ilocaln to the ground line GND. The current-source transistors TAIL1/TAIL2/ . . . /TAILn form a current mirror circuit CM3 together with the n-channel enhancement type field effect transistor N5. The ratio between the current Ibias and the current Ilocal1/Ilocal2/ . . . /Ilocaln is variable depending upon the ratio of channel dimensions between the n-channel enhancement type field effect transistor N5 and the n-channel enhancement type current-source transistor TAIL1/TAIL2/. . . /TAILn. In order to decrease the amount of current consumption in the stand-by mode, the currents ISTD and IMIRR are designed to be tens micro-amperes, and the field effect transistors are designed to flow a large amount of current Ibias and a large amount of current Ilocal1/Ilocal2/ . . . /Ilocaln.

A p-channel enhancement type field effect transistor Phase a source-and-drain path between the power voltage line Vdd and the node Vsource, and an inverted control signal STBY is supplied from an inverter INV1 to the gate electrode of the p-channel enhancement type field effect transistor P6. An n-channel enhancement type field effect transistor N8 has a source-and-drain path between the bias node Vbias and the ground line GND, and a control signal STBY is supplied to the gate electrode of the n-channel enhancement type field effect transistor N8.

An n-channel enhancement type field effect transistor N4 and a pulse generator PG1 are incorporated in the prior art bias control circuit, and form in combination a return accelerator ACL1. The n-channel enhancement type field effect transistor N4 has a source-and-drain path between the node Vsource and the ground line GND, and an output pulse PLS1 is supplied from the pulse generator PG1 to the gate electrode of the n-channel enhancement type field effect transistor N4.

FIG. 3 illustrates the pulse generator PG1. The pulse generator PG1 includes a NOR gate NR1 and a series of delay circuit DLY1 and an inverter INV2. The control signial STBY is directly supplied to one input node of the NOR gate NR1, and an inverted control signal STBYB is supplied from the inverter INV2 to the other input node of the NOR gate NR1 after a delay time. When the control signal STBY is changed from the high level to the low level, the NOR gate NR1 shifts the output pulse PLS1 to the high level, and maintains the output pulse PLS1 at the high level for the time period equal to the delay time. Upon expiry of the delay time, the NOR gate NR1 recovers the output pulse PLS1 to the low level. The pulse duration is variable together with the delay time.

Subsequently, description is made on the circuit behavior of the prior art bias circuit. While the prior art bias circuit is staying in the standby mode, the control signal STBY is in the high level. The control signal STBY keeps the transfer gate N3/P1 off, and the n-channel enhancement type field effect transistor NS and the p-channel enhancement type field effect transistor P6 are turned on. The p-channel enhancement type field effect transistor P6 charges the node Vsource to the positive power voltage level, and the positive power voltage level at the node Vsource causes the p-channel enhancement type field effect transistors P2/P3 to turn off. For this reason, the currents IMIRR and Ibias are zero. The output pulse PLS1 has been recovered to the low level, and the n-channel enhancement type field effect transistor N4 is turned off. Foi this reason, any current flows out from the node Vsource.

The n-channel enhancement type field effect transistor N8 discharges the bias node Vbias, and keeps the bias node Vbias at zero. With zero volt at the bias node Vbias, the n-channel enhancement type field effect transistor N5 and the n-channel enhancement type current-source transistors TAIL1/TAIL2/ . . . /TAILn are turned off. Any current flows through the n-channel enhancement type current-source transistors TAIL1/TAIL2/ . . . /TAILn. Thus, the prior art bias control circuit minimizes the current consumption of the load circuits L1/L2/ . . . /Ln.

In the active mode, the control signal STBY is in the low level, and the output pulse PLS1 is also in the low level. The output pulse PLS1 keeps the n-channel enhancement type field effect transistor N4 in the off-state. The transfer gate N3/P1 is turned on, and the n-channel enhancement type field effect transistor N8 and the p-channel enhancement type field effect transistor P6 are turned off. The amount of current IMIRR is equal to the product between the amount of current ISTD and the ration of the channel dimensions between the n-channel enhancement type field effect transistor N1 and the n-channel enhancement type field effect transistor N2. The amount of current Ilocal1–Ilocaln is equal to the product between the amount of current Ibias and the ratio of channel dimensions between the n-channel enhancement type field effect transistor N5 and the n-channel enhancement type current-source transistor TAIL1–TAILn. The node Vsource is regulated to an appropriate voltage level VP so as to flow the amount of current IMIRR, and the bias node Vbias is also regulated to an appropriate voltage level VN so as to flow the amount of current Ibias.

When the control signal STBY is changed from the high level to the low level, the prior art bias controller is recovered from the standby mode to the active mode, and the n-channel enhancement type current-source transistors TAIL1–TAILn increase the currents Ilocal1–Ilocaln to the appropriate value as follows.

First, assuming now that the return accelerator ACL1 is not incorporated in the prior art bias controller, the control signal STBY is simply supplied to the gate electrode of the inverter INV1, the gate electrode of the p-channel enhancement type field effect transistor P1 and the gate electrode of the n-channel enhancement type field effect transistor N8. The control signal STBY is changed from the high level to the low level at time t1 (see FIG. 4A), and the node Vsource is gradually falling from the potential level VP through the discharging via n-channel enhancement type field effect transistor N2. Accordingly, the p-channel enhancement type field effect transistors P2/P3 increases the currents IMIRR and Ibias, and the bias node Vbias is rising toward the potential level VN. The reason for the gradual potential increase is the parasitic capacitor respectively coupled to the nodes Vsource and Vbias. Especially, the conductive line from the bias node Vbias to the gate electrode of the current-source transistor TAILn is relatively long, and the parasitic capacitance coupled to the bias node Vbias is several pF to tens pF, Another reason is a small current driving capability of the n-channel enhancement type field effect transistor N2. The n-channel enhancement type current-source transistors TAIL1–TAILn gradually increase the channel conductance together with the potential level at the bias node Vbias, and gradually increase the amount of current Ilocal1–Ilocaln. The bias node Vbias reaches the potential level VN at time t10, and, accordingly, the current Ilocal1–Iocaln is saturated. Thus, the prior art bias controller without the return accelerator ACL1 requires the long recovery time from time t1 to time t10, and is several microseconds. The long recovery time is also derived from the large amount of parasitic capacitors coupled to the nodes Vsource/Vbias and the small current driving capability of the n-channel enhancement type field effect transistor N2.

The prior art bias controller with the return accelerator ACL1 differently behaves under a long pulse duration and a short pulse duration as shown in FIGS. 4B and 4C. The output pulse rises at time t2, and falls at time t7 (see FIG. 4B) or time t4 (see FIG. 4C). Thus, the pulse duration is different between the circuit behavior shown in FIG. 4B and the circuit behavior shown in FIG. 4C. In FIGS. 4B and 4C, plots PL1 and PL2 are indicative of the potential variation observed in the prior art bias controller without a return accelerator ACL1.

The control signal STBY is changed from the high level to the low level at time t1, and the return accelerator ACL1 changes the output pulse PLS1 to the high level at time t2. The output pulse PLS1 changes the n-channel enhancement type field effect transistor N4 to the on-state, and the n-channel enhancement type field effect transistor N4 rapidly discharges the current from the node Vsource to the ground line GND. For this reason, the node Vsource goes down to the low level at time t3. This results in that the p-channel enhancement type field effect transistors P2/P3 fully turn on. The return accelerator ACL1 keeps the output pulse PLS1 at the high level for the relatively long time period, and recovers the output pulse PLS1 to the low level at time t7. For this reason, the bias node Vbias exceeds the potential level VN at time t6, and is decayed to the potential level VN at time t8 after the recovery of the pulse signal PLS1 to the low level at time t7. The excess potential level causes the n-channel enhancement type current-source transistors TAIL1–TAILn to flow the current Ilocal1–Ilocaln larger than the target value Itg.

Although the recovery time is shortened, an extremely large amount of current Ilocal1–Ilocaln flows through the load circuit L1/L2/ . . . /Ln, and is causative of undesirable latch-up phenomenon and high temperature.

On the other hand, if the return accelerator ACL1 recovers the output pulse PLS1 to the low level at time t4 (see FIG. 4C), the n-channel enhancement type field effect transistor N4 turns off, and the potential rise at the bias node Vbias is decelerated For this reason, the n-channel enhancement type current-source transistors TAIL1 to TAILn consume relatively long time until the currents Ilocal1–Ilocaln reach the target value Itg.

As will be understood from the foregoing description, the return accelerator ACL1 is so sensitive to the pulse duration of the output pulse PLS1 that the manufacturer encounters a problem in a trade-off between the recovery time and the malfunction. As described hereinbefore, the pulse duration is defined by the delay circuit DLY1, and the manufacturer designs the delay circuit DLY1 to introduce a delay time optimum to the discharging from the node Vsource. However, the transistor characteristics of the delay circuit DLY1 and, accordingly, the delay time are strongly affected by fluctuation in the fabrication process. Moreover, the operating temperature and the fluctuation of power voltage Vdd unintentionally vary the delay time and, accordingly, the pulse duration. Thus, it is difficult to strictly adjust the pulse duration to the optimum value.

SUMMARY OF THE INVENTION

It is therefore an important object of the present invention to provide a bias control circuit, which optimizes a time for accelerating a recovery from a standby mode to an active mode.

To accomplish the object, the present invention proposes to compare the amount of bias current with the amount of reference current for determining an end point of an accelerating period.

In accordance with one aspect of the present invention, there is provided a semiconductor integrated circuit comprising a main circuit flowing a first current to be controlled, and a bias current controlling circuit including a bias current controller connected to the main circuit, generating a reference current and regulating the first current to a first value with respect to the amount of the reference current in a first mode and to a second value less than the first value in a second mode, a mode changer connected to the bias current controller and responsive to an instruction representative of a mode change between the first mode and the second mode for chancing the bias current controller between the first mode and the second mode and a recovery accelerator connected to the bias current controller and the mode changer, responsive to the instruction for accelerating the change from the second mode to the first mode and comparing the amount of the first current with the amount of the reference current for determining an end point of the acceleration of the change.

BRIEF DESCRIPTION OF THE DRAWINGS

The features and advantages of the semiconductor integrated circuit device will be more clearly understood from the following, description taken in conjunction with the accompanying drawings in which.

DESCRIPTION OF THE PREFERRED EMBODIMENTS

First Embodiment

Figure 1:
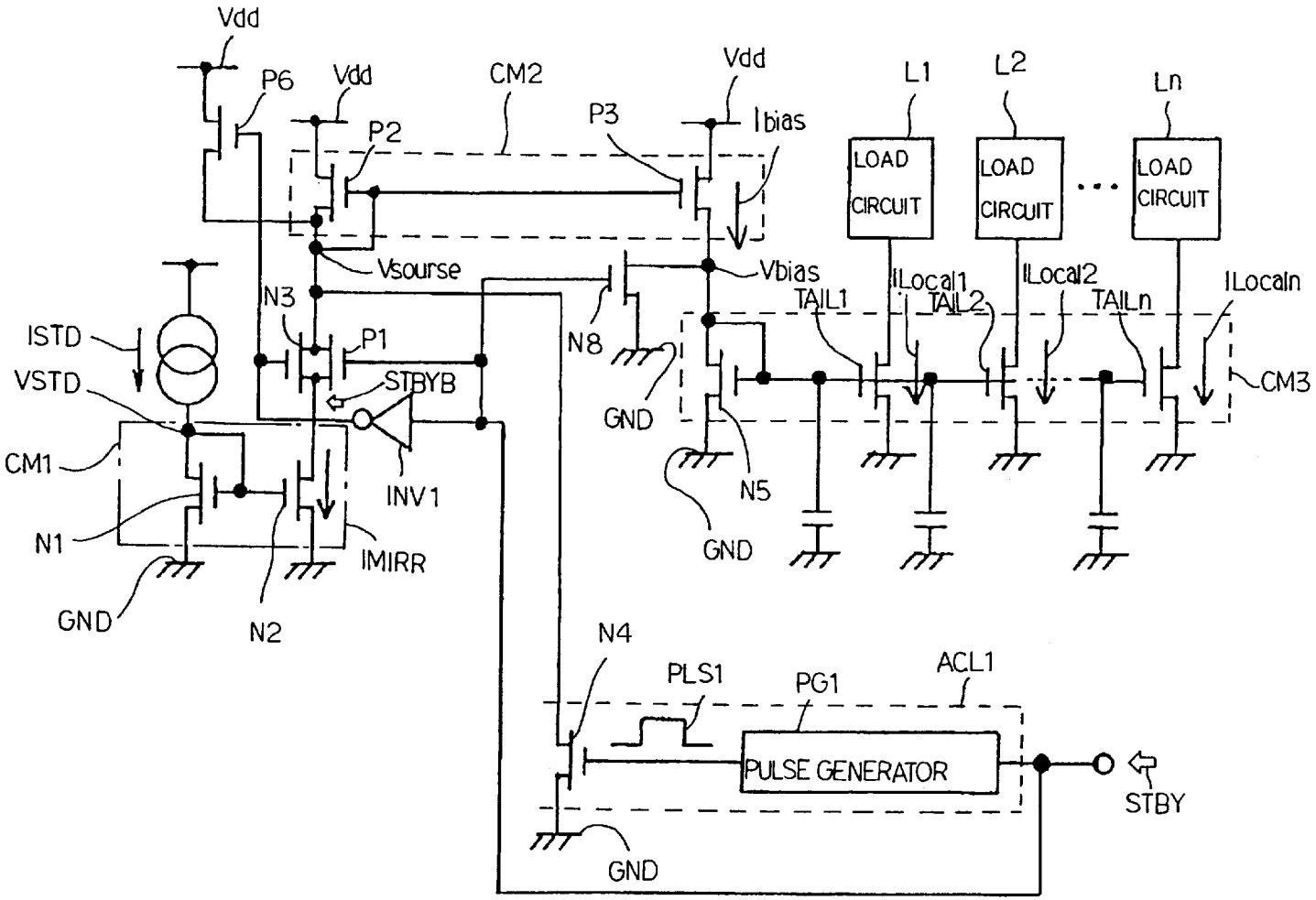
Fig. 1 PRIOR ART
FIG. 1 is a circuit diagram showing the circuit configuration of the prior art bias control circuit.
Figure 2:
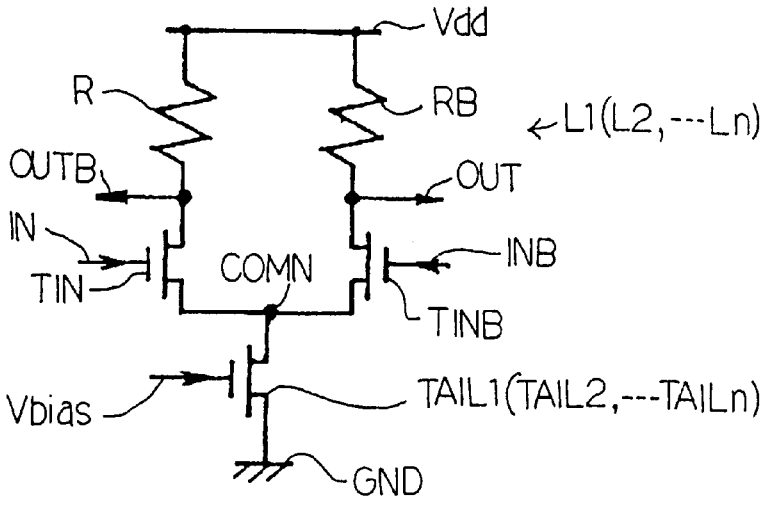
Fig. 2 PRIOR ART
FIG. 2 is a circuit diagram showing the circuit configuration of the load circuit controlled by the prior art bias control circuit.
Figure 3:
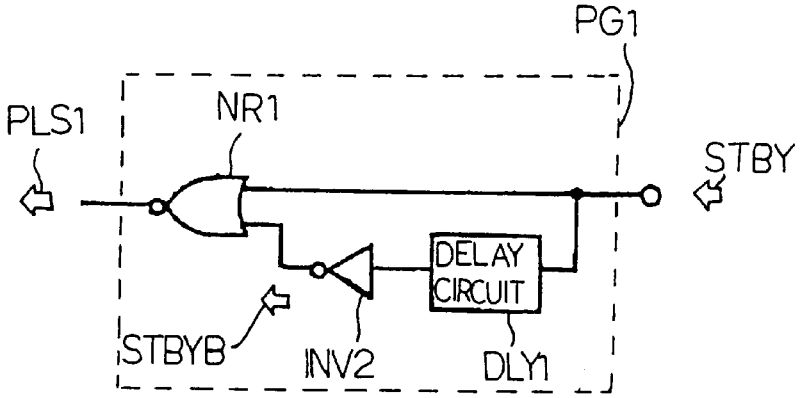
Fig. 3 PRIOR ART
FIG. 3 is a circuit diagram showing the circuit configuration of the delay circuit.
Figure 4A:
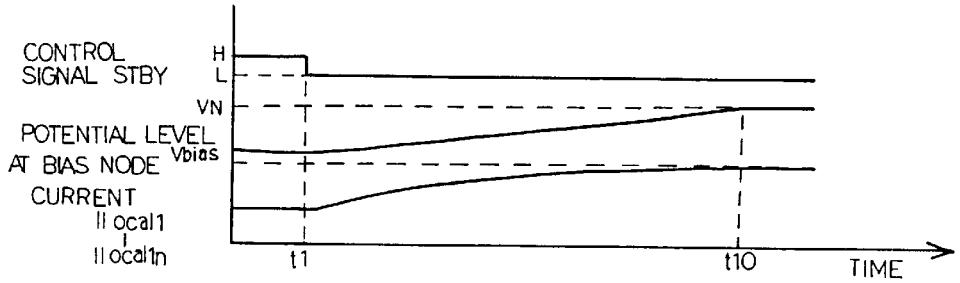
Fig. 4A PRIOR ART
FIG. 4A is a graph showing the signal waveforms observed in the prior art bias control circuit Without the return accelerator.
Figure 4B:
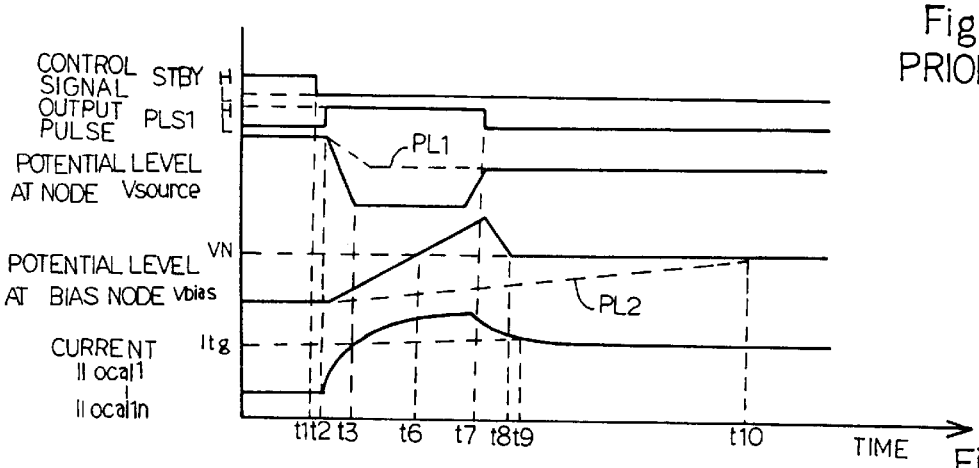
Fig. 4B PRIOR ART
FIGS. 4B and 4C are graphs showing the signal waveforms observed in the prior art bias control circuit under the short pulse duration and the long pulse duration.
Figure 4C:
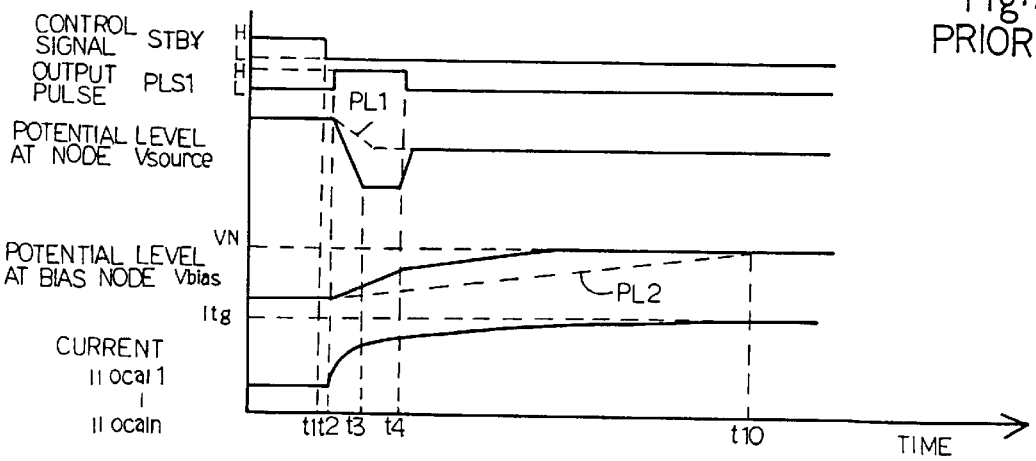
Fig. 4C PRIOR ART
Figure 5:
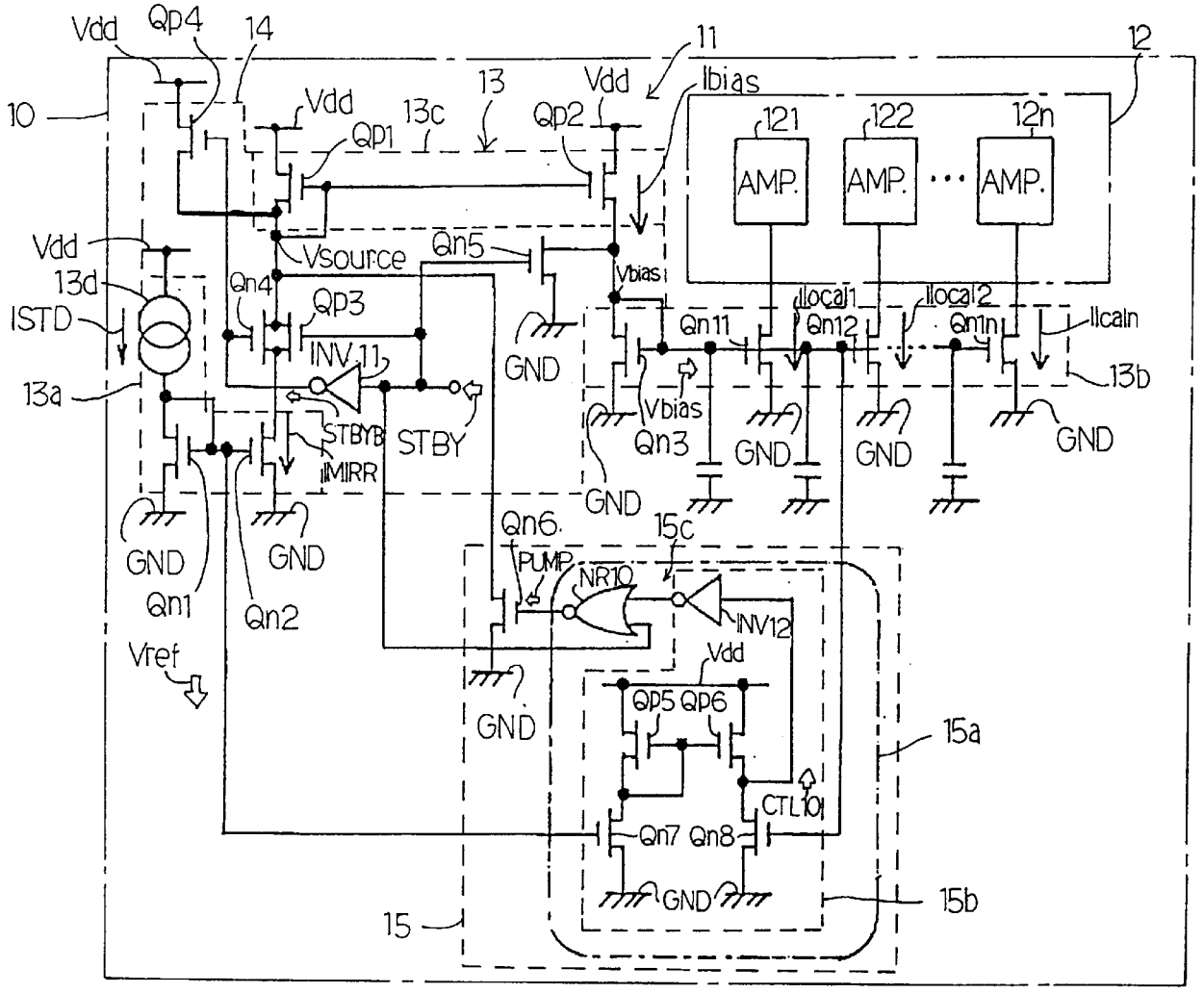
FIG. 5 is a circuit diagram showing the circuit configuration of a bias control circuit according to the present invention.

Referring to FIG. 5 of the drawings, a semiconductor integrated circuit device is fabricated on a single semiconductor chip 10. The semiconductor integrated circuit device is broken down into a bias controlling circuit 11 and an analog circuit 12 to be biased. The analog circuit 12 includes plural differential amplifiers 121/122/ . . . /12n, by way of example, and currents Ilocal1/Ilocal2/ . . . /Ilocaln flow from the differential amplifiers 121/122/ . . . /12n to a ground line GND.

The bias controlling circuit 11 largely comprises a bias current generator 13, a mode changer 14 and a recovery accelerator 15. The mode changer 14 changes the bias current generator 13 between a standby mode and an active mode. The bias current generator 13 adjusts the currents Ilocal1/Ilocal2/ . . . /Ilocaln to a constant value in the active mode, and minimizes them in the standby mode. The recovery accelerator 15 accelerates the mode change from the standby mode to the active mode.

The bias current generator 13 includes a current mirror circuit 13*a* connected between a positive power supply line Vdd and a ground line GND, a current mirror circuit 13*b* connected between the analog circuit 12 and the ground line GND and a current mirror circuit 13*c* connected between the positive power supply line Vdd and the current mirror circuits 13*a*/13*b* through the mode changer 14. The current mirror circuit 13*a* constantly flows a reference current ISTD from the positive power supply line Vdd into the ground line GND, and produces a current IMIRR substantially proportional to the reference current ISTD. The current mirror circuit 13*c* produces a bias current Ibias substantially proportional to the current IMIRR, and supplies the bias current Ibias to the current mirror circuit 13*b*. Finally, the current mirror 13*b* produces the currents Ilocal1–Ilocaln substantially proportional to the bias current Ibias.

The current mirror circuit 13*a* includes a constant current source 13*d* and a parallel combination of n-channel enhancement type field effect transistors Qn1/Qn2. The n-channel enhancement type field effect transistor Qn1 is connected between the constant current source 13*d* and the ground line GND, and the other n-channel enhancement type field effect transistor Qn2 is connected the mode changer 14 and the ground line GND. The drain node of the n-channel enhancement type field effect transistor Qn1 is connected to the gate electrodes of the n-channel enhancement type field effect transistors Qn1/Qn2. The reference current ISTD is converted to a reference voltage Vref, and the reference voltage Vref is applied to both gate electrodes of the n-channel enhancement type field effect transistors Qn1/Qn2. For this reason, the parallel combination of n-channel enhancement type field effect transistors Qn1/Qn2 varies the current IMIRR proportionally to the reference current ISTD. The reference voltage Vref is varied proportionally to the reference current ISTD, and is representative of the amount of reference current ISTD. The reference voltage Vref is further supplied to the recovery accelerator 15.

The current mirror circuit 13*c* is implemented by a parallel combination of p-channel enhancement type field effect transistors Qp1/Qp2 connected in parallel between the positive power supply line Vdd and the mode changer 14. The p-channel enhancement type field effect transistor Qp1 supplies the current IMIRR through the mode changer to the n-channel enhancement type field effect transistor Qn2, and the other p-channel enhancement type field effect transistor Qp2 flows the bias current Ibias through the mode changer 14 into the current mirror circuit 13*b*. The parallel combination of p-channel enhancement type field effect transistors Qp1/Qp2 proportionally varies the bias current Ibias with respect to the current IMIRR.

The current mirror circuit 13*b* includes a parallel combination of n-channel enhancement type field effect transistors Qn3, Qn11, Qn12, . . . and Qn1n. The n-channel enhancement type field effect transistor Qn3 is connected between the mode changer 14 and the ground line GND, and flows the bias current Ibias into the ground line GND. The drain node of the n-channel enhancement type field effect transistor Qn3 is connected to the gate electrode of the n-channel enhancement type field effect transistor Qn3 and the gate electrodes of the n-channel enhancement type field effect transistors Qn11/Qn12/. . . /Qn1n. The n-channel enhancement type field effect transistor Qn3 converts the bias current Ibias to a bias voltage Vbias, and the bias voltage Vbias is applied to the gate electrodes of the n-channel enhancement type field effect transistors Qn3/Qn11/Qn12/ . . . /Qn1n. Thus, the current mirror circuit 13*b* produces the currents Ilocal1/Ilocal2/ . . . /Ilocaln proportionally to the bias current Ibias. The bias voltage Vbias is further supplied to the recovery accelerator 15.

The mode changer 14 includes a parallel combination of p-channel enhancement type field effect transistor Qp3 and n-channel enhancement type field effect transistor Qn4, a p-channel enhancement type field effect transistor Qp4, an n-channel enhancement type field effect transistor Qn5 and an inverter INV11. A control signal STBY is supplied to the inverter INV10, and the inverter INV10 produces an inverted control signal STBYB from the control signal STBY. The parallel combination Qp3/Qn4 is connected between the p-channel enhancement type field effect transistor Qp1 and the n-channel enhancement type field effect transistor Qn2, and the control signal STBY and the inverted control signal STBYB are supplied to the gate electrode of the p-channel enhancement type field effect transistor Qp3 and the gate electrode of the n-channel enhancement type field effect transistor Qn4, respectively. The p-channel enhancement type field effect transistor Qp4 is connected between the positive power supply line Vdd and the drain node Vsource of the p-channel enhancement type field effect transistor Qp1, and is gated by the inverted control signal STBYB. The n-channel enhancement type field effect transistor Qn5 is connected between the drain node Vbias of the p-channel enhancement type field effect transistor Qp2 and the ground line GND, and the control signal STBY is supplied to the gate electrode of the n-channel enhancement type field effect transistor QnS.

The control signal STBY of a low level is indicative of the active mode, and the high level is representative of the standby mode. While the control signal STBY is staying at the low level, the p-channel enhancement type field effect transistor Qp4 and the n-channel enhancement type field effect transistor Qn5 are turned off, and the transfer gate Qp3/Qn4 is turned on. The p-channel enhancement type field effect transistor Qp4 electrically isolates the drain node Vsource of the p-channel enhancement type field effect transistor Qp1 from the positive power supply line Vdd, and the n-channel enhancement type field effect transistor Qn5 electrically isolates the drain node Vbias of the p-channel enhancement type field effect transistor Qp2 from the ground line GND. The parallel combination Qp3/Qn4 passes the current IMIRR to the n-channel enhancement type field effect transistor Qn2, and the mode changer 14 allows the current mirror circuits 13*a*/13*c*/13*b* to produce the bias current Ibias proportional to the reference current ISTD.

On the other hand, while the control signal STBY is in the high level, the parallel combination Qp3/Qn4 is turned off, and the p-channel enhancement type field effect transistor Qp4 and the n-channel enhancement type field effect transistor Qp2 are turned on. The parallel combination Qp3/Qn4 blocks the current mirror circuit 13*a* from the current mirror circuit 13*c*. The p-channel enhancement type field effect transistor Qp4 supplies the positive power voltage to the gate electrodes of the p-channel enhancement type field effect transistors Qp1/Qp2, and causes the p-channel enhancement type field effect transistors Qp1/Qp2 to turn off. The current mirror circuit 13*c* does not supply the current IMIRR and the bias current Ibias to the other current mirror circuits 13*a*/13*b*. Moreover, the n-channel enhancement type field effect transistor Qn5 turns on, and discharges the remaining bias current Ibias to the ground line GND, and fixes the drain node, Vbias to the ground level. As a result, the n-channel enhancement type field effect transistors Qn3/Qn11/Qn12/. . . /Qn1n turn off, and the currents Ilocal1/Ilocal2/. . . /Ilocaln are minimized.

The recovery accelerator 15 includes an n-channel enhancement type field effect transistor Qn6 and a controller 15*a*. The n-channel enhancement type field effect transistor Qn6 is connected between the drain node Vsource of the p-channel enhancement type field effect transistor Qp1 and the ground line GND, and the controller 15*a* changes the n-channel enhancement type field effect transistor Qn6 between the on-state and the off-state. While the bias control circuit is in the active mode, the controller keeps the n-channel enhancement type field effect transistor Qn6 in the off-state, and does not offer any additional current path to the current flowing out from the current mirror circuit 13*c*. When the control signal STBY is changed from the high level to the low level, the controller 15*a* changes the n-channel enhancement type field effect transistor Qn6 to the on-state, and the n-channel enhancement type field effect transistor Qn6 offers an additional current path to the current flowing out from the current mirror circuit 13*c* so as to accelerate the recovery to the active mode.

The controller 15*a* is broken down into two sections, i.e., an end-point detector 15*b* and a logic circuit 15*c*. The end-point detector is connected between the positive power supply line Vdd and the ground line GND, and compares the bias voltage Vbias with the reference voltage Vref to see whether or not the accelerating period is expired. When the control signal STBY is changed from the high level to the low level, the logic circuit 15*c* supplies the high level to the n-channel enhancement type field effect transistor Qn6, and changes it to the on-state. Thereafter, the end-point detector 15*b* determines that the acceleration reaches the end point, and the logic circuit 15*c* changes the n-channel enhancement type field effect transistor Qn6 to the off-state.

The end-point detector 15*b* includes a parallel combination of p-channel enhancement type field effect transistors Qp5/Qp6 connected to the positive power supply line Vdd, two n-channel enhancement type field effect transistors Qn7/Qn8 connected between the p-channel enhancement type field effect transistors Qp5/Qp6 and the ground line GND and an inverter INV12. The p-channel enhancement type field effect transistors Qp5/Qp6 have respective gate electrodes connected to the common drain node between the p-channel enhancement type field effect transistor Qp5 and the n-channel enhancement type field effect transistor Qn7, and forms a current mirror circuit. The reference voltage Vref and the bias voltage Vbias are supplied to the gate electrode of the n-channel enhancement type field effect transistor Qn7 and the gate electrode of the other n-channel enhancement type field effect transistor Qn8. The n-channel enhancement type field effect transistor Qn7 is equal in transistor characteristics to the other n-channel enhancement type field effect transistor Qn8, and a control signal CTL10 is supplied from the common drain node between the p-channel enhancement type field effect transistor Qp6 and the n-channel enhancement type field effect transistor Qn8 to the inverter INV12. The potential level of the control signal CTL10 is inversely proportional to the potential level of the bias voltage Vbias. When the bias voltage Vbias reaches a predetermined value VN, the control signal CTL10 becomes lower than the threshold of the inverter INV12, and the inverter INV12 changes the potential level at the output node thereof. Thus, the end-point detector 15*b* detects the end point through the voltage comparison between the reference voltage Vref and the bias voltage Vbias.

The logic circuit 15*c* includes a NOR gate NR10 connected to the inverter INV12. The control signal STBY and the output signal of the inverter INV12 are supplied to the NOR gate NR10. The output node of the NOR gate NR10 is connected to the gate electrode of the -channel enhancement type field effect transistor Qn6, and supplies a pulse signal PUMP to the gate electrode of the n-channel enhancement type field effect transistor Qn6.

The p-channel enhancement type field effect transistors Qp5/Qp6 are responsive to the potential level at the common drain node, and supply currents to the n-channel enhancement type field effect transistors Qn7/Qn8. The p-channel enhancement type field effect transistor Qp5 offers the channel resistances against the currents, and the channel resistances are equally varied depending upon the potential level at the common drain node and, accordingly, the reference voltage Vref. However, the n-channel enhancement type field effect transistors Qn7/Qn8 vary the channel resistances depending upon the reference voltage Vref and the bias voltage Vbias. Although the reference voltage Vref is constant, the bias voltage Vbias rises in the transient period from the standby mode to the active mode, and the potential level at the common drain node between the p-channel enhancement type field effect transistor Qp6 and the n-channel enhancement type field effect transistor Qn8 is decreased. The potential level at the common drain node is supplied to the inverter INV12 as the control signal CTL10. When the control signal CTL10 becomes lower than the threshold of the inverter INV12, the inverter INV12 changes the output node thereof to the high level, and the NOR gate NR10 changes the output node thereof to the low level. As a result, the n-channel enhancement type field effect transistor Qn6 turns off.

Figure 6:
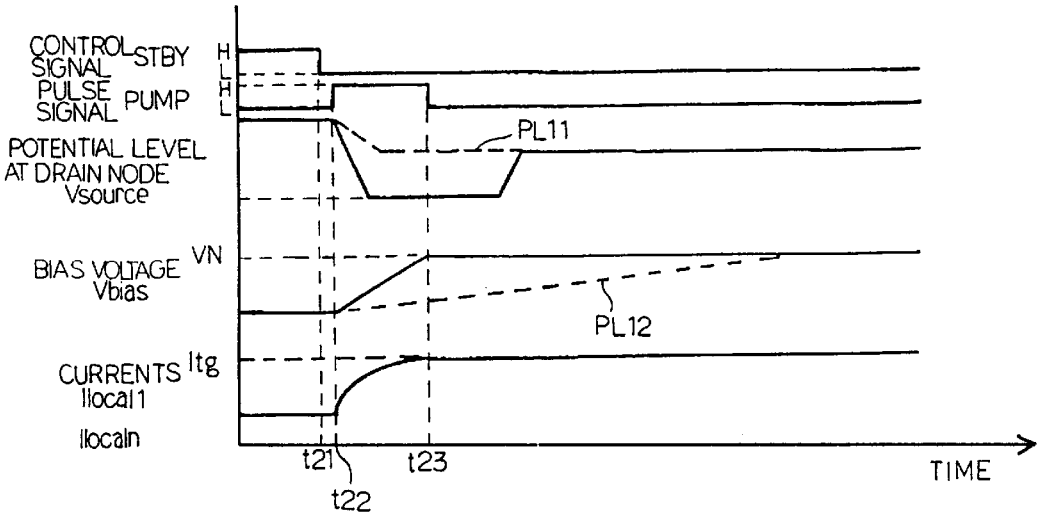
FIG. 6 is a graph showing the signal waveforms at essential nodes in the bias control circuit.

FIG. 6 illustrates the circuit behavior of the bias controller shown in figure 5. The bias controller 11 behaves as similar to the prior art bias controller in the active mode and the standby mode. However, the bias controller 11 differently behaves in the recovery from the standby mode to the active mode, and description is focused on the circuit behavior in the recovery.

While the bias controller 11 is in the standby mode, the control signal STBY is in the high level, and the inverter INV12 supplies the low level to the NOR gate NR10. The NOR gate NR10 keeps the pulse signal PUMP in the low level. Plots P10/PL11 are indicative of the potential variation of the prior art bias controller without an recovery accelerator.

The control signal STBY is changed to the low level at time t21, and, accordingly, the NOR gate NR10 changes the pulse signal PUMP to the high level at time t22. Then, the n-channel enhancement type field effect transistor Qn6 turns on. The control signal STBY causes the transfer gate Qp3/Qn4 to turn on and the p-channel enhancement type field effect transistor Qp4 and the n-channel enhancement type field effect transistor Qn5 to turn off. Then, the drain node Vsource is discharged through both of the n-channel enhancement type field effect transistors Qn2 and Qn6, and the potential level rapidly goes down.

The potential level at the drain node Vsource is supplied to the gate electrodes of the p-channel enhancement type field effect transistors Qp1/Qp2, and the rapid potential fall causes the p-channel enhancement type field effect transistor Qp2 to increase the bias current Ibias and, accordingly, the bias voltage Vbias.

The bias voltage Vbias feaches the predetermined voltage level VN at time t23, and the currents Ilocal1–Ilocaln is increased to the target value Itg. The bias voltage Vbias is supplied to the gate electrode of the n-channel enhancement type field effect transistor Qn8, and the n-channel enhancement type field effect transistor Qn8 decreases the channel resistance. As a result, the control signal CTL10 becomes lower than the threshold of the inverter INV12, and the inverter INV12 supplies the high level to the NOR gate NR10. The NOR gate NR10 recovers the pulse signal PUMP to the low level, and the n-channel enhancement type field effect transistor Qn6 turns off.

As will be appreciated from the foregoing description, the end-point detector 15*b* monitors the bias voltage Vbias in order to determine the end point of the acceleration. Even if process fluctuation affects the transistor characteristics, the end-point detector 15*b* accurately determines the end point of the acceleration, and prohibits the bias controller 11 from the malfunction. The end-point detector 15*b* is also free from a difference between the designed operating temperature and an actual operating temperature, and accurately gives the end point of the acceleration.

In this instance, the analog circuit 12 serves as a main circuit, and the active mode and the standby mode are corresponding to a first mode and a second mode, respectively.

Second Embodiment

Figure 7:
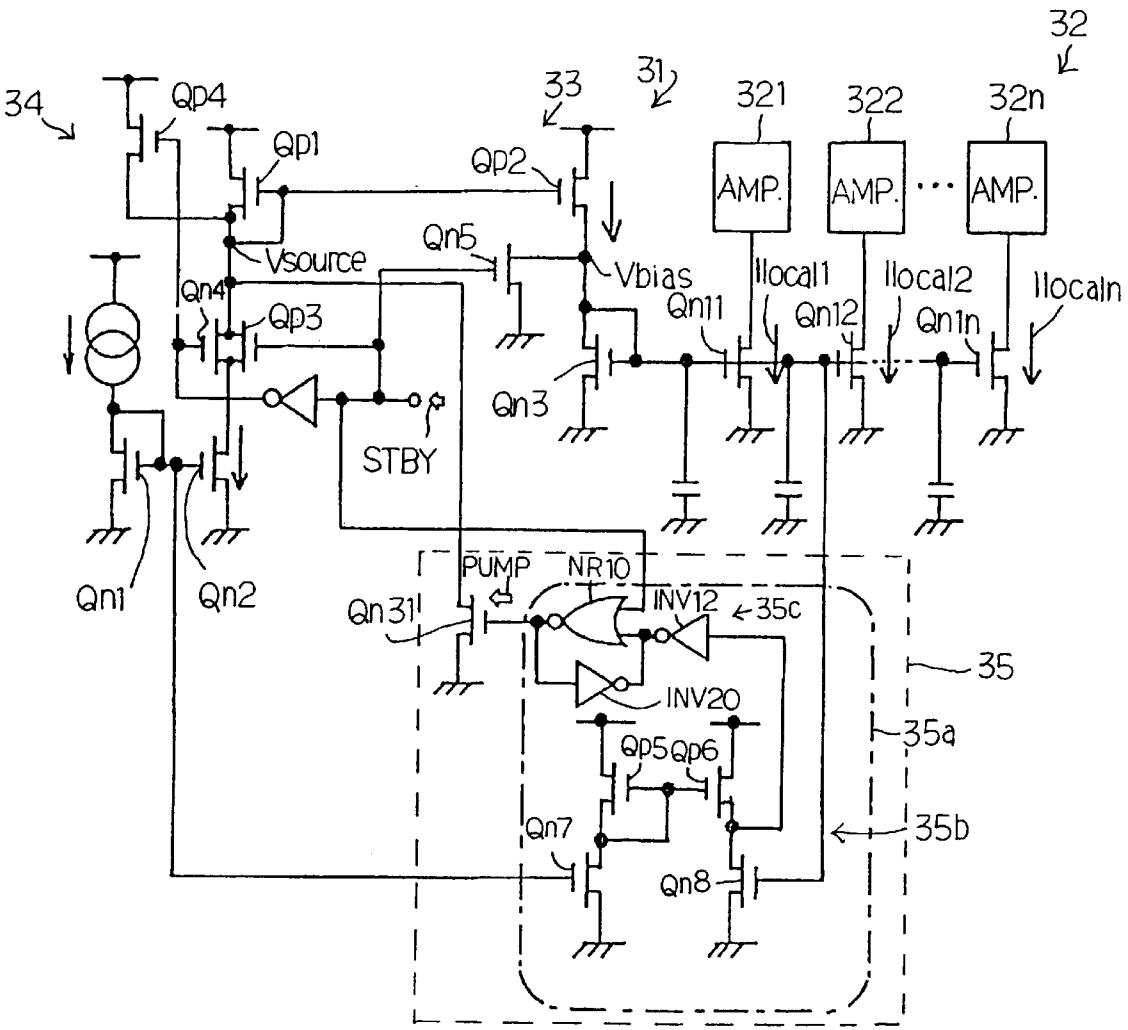
FIG. 7 is a circuit diagram showing the circuit configuration of another bias control circuit according to the present invention.

Turning to FIG. 7 of the drawings, another semiconductor integrated circuit device embodying the present invention comprises a bias controller 31 and an analog circuit 32 both integrated on a semiconductor chip (not shown). The analog circuit 32 includes amplifiers 321/322/ . . . /32n, and the bias controller 31 includes a bias current generator 33, a mode changer 34 and a recovery accelerator 35. The bias current generator 33 and the mode changer 34 are similar to those of the first embodiment, and no further description is hereinlater incorporated for the sake of simplicity.

The recovery accelerator 35 includes an n-channel enhancement type field effect transistor Qn31 and a controller 35*a*, which is broken down into an end-point detector 35*b* and a logic circuit 35*c*. The end-point detector 35*b* is similar in circuit configuration to the end-point detector 15*b*, and detailed description is omitted.

An inverter INV20 is added to the logic circuit 15*c*. The other circuit components are labeled with the same references designating corresponding circuit components of the logic circuit 15*c*. The inverter INV20 has an input node and an output node respectively connected to the output node and the input node of the NOR gate NR10. The inverter INV20 gives a hysteresis to the behavior ofthe NOR gate NR10.

Figure 8:
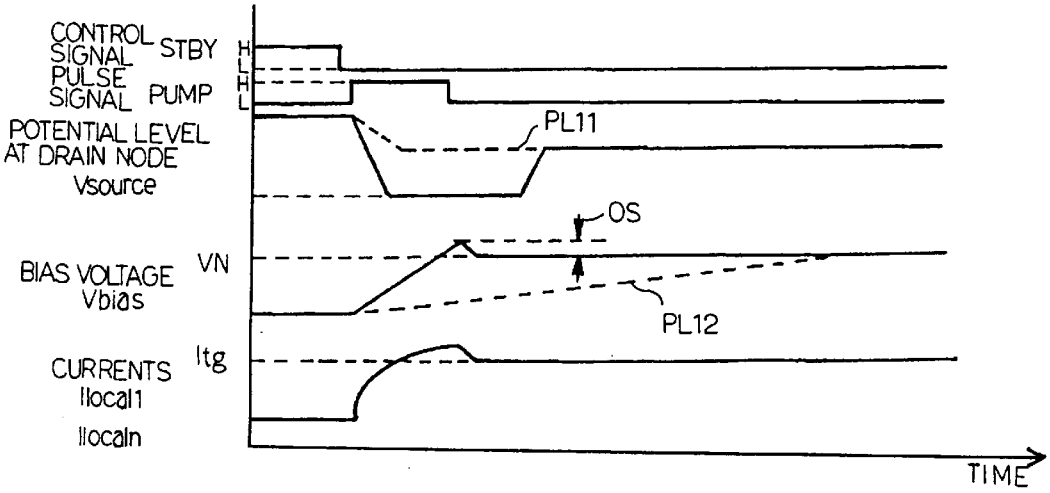
FIG. 8 is a graph showing the signal waveforms at essential nodes in the bias control circuit.

FIG. 8 illustrates the circuit behavior of the bias controller 31 in the recovery from the standby mode to the active mode. The hysteresis is causative of an overshoot OS in the waveform of the bias voltage Vbias, and the recovery time is slightly prolonged rather than the recovery time of the first embodiment. However, the hysteresis makes the detecting characteristics stable. When the amount of current passing through the n-channel enhancement type field effect transistor Qn7 is close to the amount of current passing through the n-channel enhancement type field effect transistor Qn8, the end-point detector 35*b* accurately determines the end point of the acceleration.

Although particular embodiments of the present invention have been shown and described, it will be apparent to those skilled in the art that various changes and modifications may be made without departing from the spirit and scope of the present invention.

The analog circuit to be biased is never limited to the amplifiers 121 to 12*n*. The bias controller is available for any kind of analog circuit in so far as the analog circuit is changed between the standby mode and the active mode by changing the bias voltage.

The bias controlling circuit may flow a small amount of current between the analog circuit and the ground line gnd in the standby mode.

What is claimed is:

1. A semiconductor integrated circuit comprising:

a main circuit flowing a first current to be controlled; and a bias current controlling circuit including a bias current controller connected to said main circuit, generating a reference current and regulating said first current to a first value with respect to the amount of said reference current in a first mode and to a second value less than said first value in a second mode, a mode changer connected to said bias current controller and responsive to an instruction representative of a mode change between said first mode and said second mode for changing said bias current controller between said first mode and said second mode, and a recovery accelerator connected to said bias current controller and said mode changer, responsive to said instruction for accelerating the change from said second mode to said first mode and comparing the amount of said first current with the amount of said reference current for determining an end point of the acceleration of said chance.

2. The semiconductor integrated circuit device as set forth in claim 1, in which said recovery accelerator includes a voltage comparator comparing a first bias voltage converted from a second current proportional to said first current with a reference voltage produced from said reference current so as to produce a first control signal when said acceleration reaches said end point, a logic circuit responsive to said instruction and said first control signal so a to change a second control signal from an inactive level to an active level during said acceleration, and an accelerating transistor responsive to said second control signal for accelerating said change.

3. The semiconductor integrated circuit device as set forth in claim 2, in which said accelerating transistor provides a current path from a first node of said bias current controller to a source of first constant voltage, and said mode changer allows current to flow through said first node so as to change said bias current controller from said second mode to said first mode.

4. The semiconductor integrated circuit device as set forth in claim 2, in which said voltage comparator includes a current mirror circuit connected to a source of second constant voltage different from said first constant voltage and responsive to a second bias voltage for supplying a third current to a first output node and a fourth current proportional to said third current to a second output node, a first transistor connected between said first output node and said source of first constant voltage and responsive to said reference voltage so as to provide a first resistance against said third current for producing said second bias voltage, a second transistor connected between said second output node and said source of first constant voltage and responsive to said first bias voltage so as to provide a second resistance against said fourth current for producing a third control signal, and a logic gate responsive to said third control signal for producing said first control signal.

5. The semiconductor integrated circuit device as set forth in claim 4, in which said third control signal increases the potential level during said acceleration, and said logic gate produces said first control signal when said third control signal exceeds a threshold thereof.

6. The semiconductor integrated circuit device as set forth in claim 1, in which said bias current controller includes a first current mirror circuit connected between a source of first constant voltage and a source of second constant voltage different in magnitude from said first constant voltage and supplied with said reference current for regulating a second current proportionally to said reference current, a second current mirror circuit connected between said source of second voltage and said first current mirror circuit for regulating a third current proportionally to said second current, and a third current mirror circuit connected between said second current mirror circuit and said source of first constant voltage for regulating said first current proportionally to said third current.

7. The semiconductor integrated circuit device as set forth in claim 6, in which said mode changer is connected between said second current mirror circuit and said first and third current mirror circuits, and decreases said second and third currents to zero in said second mode.

8. The semiconductor integrated circuit device as set forth in claim 7, in which said mode changer includes a gate means connected between said second current mirror circuit and said first current mirror circuit and responsive to said instruction for interrupting said second current in said second mode, said first gate means allowing said second current to flow from said second current mirror circuit to said first current mirror circuit, a first switching transistor connected between said source of second constant voltage and a first intermediate node between said second current mirror circuit and said gate means and responsive to said instruction so as to supply said second constant voltage through said first intermediate node to said second current mirror circuit in said second mode for decreasing said second and third currents to zero, said first switching transistor blocking said first intermediate node from said source of second constant voltage in said first mode, and a second switching transistor connected between said source of first constant voltage and a second intermediate node between said second current mirror circuit and said third current mirror circuit and responsive to said instruction so as to connect said second intermediate node to said first constant voltage in said second mode, said second switching transistor blocking said second intermediate node from said source of first constant voltage.

9. The semiconductor integrated circuit device as set forth in claim 8, in which said recovery accelerator has an accelerating transistor connected between said first intermediate node and said source of first constant voltage for providing a current path between said first intermediate node and said source of first constant voltage during said acceleration.

10. The semiconductor integrated circuit device as set forth in claim 9, in which said recovery accelerator further includes a voltage comparator comparing a first bias voltage converted from said third current with a reference voltage converted from said reference current so as to produce a first control signal when said acceleration reaches said end point, and a logic circuit responsive to said instruction and said first control signal so a to supplying a second control signal to said accelerating transistor during said acceleration.

11. The semiconductor integrated circuit device as set forth in claim 10, in which said voltage comparator includes a current mirror circuit connected to said source of second constant voltage and responsive to a second bias voltage for supplying a fourth current to a first output node and a fifth current proportional to said fourth current to a second output node, a first transistor connected between said first output node and said source of first constant voltage and responsive to said reference voltage so as to provide a first resistance against said fourth current for producing said second bias voltage, a second transistor connected between said second output node and said source of first constant voltage and responsive to said first bias voltage so as to provide a second resistance against said fifth current for producing a third control signal, and a logic gate responsive to said third control signal for producing said first control signal.

12. The semiconductor integrated circuit device as set forth in claim 11, in which said third control signal increases the potential level during said acceleration, and said logic gate changes said first control signal from a low level to a high level when said third control signal exceeds a threshold thereof.

13. The semiconductor integrated circuit device as set forth in claim 12, in which said instruction is represented by a fourth control signal having said high level in said second mode and said low level in said first mode, and a first inverter and a NOR gate respectively serve as said logic gate and said logic circuit.

14. The semiconductor integrated circuit device as set forth in claim 13, in which said logic circuit further includes a second inverter having an input node connected to an output node of said NOR gate and an output node connected to an input node of said NOR gate, and said second inverter gives a hysteresis to a logic function of said NOR gate.

* * * * *

UNITED STATES PATENT AND TRADEMARK OFFICE

CERTIFICATE OF CORRECTION

PATENT NO. : 6,163,206
DATED : December 19, 2000
INVENTOR(S) : Shotaro Kobayashi It is certified that error appears in the above-identified patent and that said Letters Patent is hereby corrected as shown below:

Column 2,
Line 63, delete "Phase" insert -- P6 has --

Column 5,
Line 60, delete "chancing" insert -- changing --

Column 6,
Line 15, delete "Without" insert -- without --

Column 7,
Line 7, after "connected" insert -- is --

Column 8,
Line 12, delete "$Q_nS$" insert -- $Q_n5$ --

Column 12,
Line 5, delete "chance" insert -- change --

Signed and Sealed this

Eleventh Day of December, 2001

*Attest:*

Nicholas P. Godici

*Attesting Officer*

NICHOLAS P. GODICI
*Acting Director of the United States Patent and Trademark Office*